US005816432A

United States Patent [19]

Hammen et al.

[11] Patent Number: 5,816,432

[45] Date of Patent: Oct. 6, 1998

[54] ICE CHEST CONTAINER PARTITION DEVICE

[76] Inventors: Robert J. Hammen; Linda G. Hammen, both of 504 Riverview Ct., Red Lion, Pa. 17356

[21] Appl. No.: 813,605

[22] Filed: Mar. 7, 1997

[51] Int. Cl.[6] ..... B65D 25/10

[52] U.S. Cl. ..... 220/530; 220/529; 220/62; 220/691

[58] Field of Search ..... 220/500, 529, 220/530, 4.08, 4.33, 62, 691, 692, 693, 666, 668, 676, 737, 739, 903

[56] References Cited

U.S. PATENT DOCUMENTS

| | | | |
|---|---|---|---|
| 117,712 | 8/1871 | Wright | 220/467 |
| 705,270 | 7/1902 | Meyer | 62/374 |
| 1,427,166 | 8/1922 | Parton | 220/693 |
| 1,668,959 | 10/1928 | Brooks | 220/529 |
| 1,747,390 | 2/1930 | Robb | 220/529 |
| 3,379,335 | 4/1968 | Mongelluzzo | 220/62 |
| 3,401,535 | 9/1968 | Palmer | 62/457.5 |
| 4,916,923 | 4/1990 | Adams et al. | 62/457.1 |
| 5,099,607 | 3/1992 | Lawton | 220/692 |
| 5,148,932 | 9/1992 | Orefice | 220/23.4 |
| 5,318,821 | 6/1994 | Bradley, Jr. | 220/739 |

*Primary Examiner*—Stephen J. Castellano
*Attorney, Agent, or Firm*—Samuel M. Learned, Jr.

[57] ABSTRACT

An ice chest container partition device, adapted to be adjustable for different diameter beveraae containers, and employed by placement thereof within an ice chest to provide an ice retention barrier opening in the ice pack within the chest so that when a beverage container is removed it may thereafter be replaced without ice in the ice pack of the chest having fallen into and filled the ice pack opening therefor.

1 Claim, 2 Drawing Sheets

X
Y
10
10'
10a
10a'
11
12
14
16
18
20
22
24
24'
38

ICE CHEST CONTAINER PARTITION DEVICE

BACKGROUND OF THE INVENTION

The present invention relates to an accessory device for use with an ice chest cooler and enhancing the ease and convenience for one to insert, remove and replace a beverage container within the ice pack of the chest by providing an adjustable ice pack retention barrier to overcome the common and annoying problem encountered when ice falls into and fills the ice pack opening of a beverage container that is removed therefrom. Although the description and references herein will relate to use of the invention hereof for beverage containers, it is to be understood that the same device could just as readily be employed with food containers and the like for cooling in an ice chest, and the reference to beverage containers is illustrative only and not to be regarded as per se restrictive.

Among the various prior art devices for holding a beverage container within an ice pack for cooling and providing a perforated retentive barrier between the container and ice pack are those as respectively taught by Wright in U.S. Pat. No. 117,712 dated Aug. 1, 1871, and Meyer in his U.S. Pat. No. 705,270 dated Jul. 22, 1902, wherein the device taught by Meyer is of particular interest in that it is adjustable to accommodate beverage containers of different heights as opposed to beverage containers of different diameters.

Additionally provided are ice chest insert tray and rack devices for holding beverage containers in position within an ice pack of the chest, exemplary of which would be those as taught by Palmer in U.S. Pat. No. 3,401,535 dated Sept. 17, 1968, and by Adams et al in U.S. Pat. No. 4,916,923 dated Apr. 17, 1990, wherein the device taught by Adams et al embodies an adjustable rack means to accommodate ice chest coolers of different sizes. In neither of the foregoing teachings, however, is there any provision for mechanically accommodating adjustment of the beverage container holding means to beverage containers of different diameters.

The applicants herein, by their invention, provide a new and novel device for economically and conveniently overcoming the inconvenience otherwise encountered when removing a beverage container from the ice in an ice chest cooler, whereupon the ice falls into and fills the ice pack opening for the container, thereby making it inconvenient and difficult to replace the container following a use thereof.

SUMMARY OF THE INVENTION

It is the principal object of the present invention to provide an ice chest container partition device insertable within an ice chest to retainably establish and maintain an ice pack opening barrier between a beverage container placed within an ice pack within the chest for cooling, and ice within the ice pack of the chest, so that the beverage container may be conveniently inserted, withdrawn and replaced without ice in the ice pack of the chest falling into and filling the ice pack opening therefor when the beverage container is removed.

It is another object of the present invention to provide an ice chest container partition device which is adjustable to accommodate beverage containers of different diameters.

It is also an object of the present invention to provide an ice chest container partition device which may be advantageously employed to preserve a beverage container opening within the ice pack in ice chests and similar such beverage cooling apparatus wherein chipped, shaved or cubed ice is employed as the cooling medium.

It is yet another object of the present invention to provide an ice chest container partition device having perforations therein whereby cold water from the melted ice pack is enabled to pass therethrough into contact with the beverage container and thereby aid in the efficient cooling of the beverage within said container.

A further object of the present invention is to provide an ice chest container partition device which may be advantageously employed either singly or in combination, in a singly set or in adjustably varied set diameters, to accommodate similar or different sized beverage containers for ice pack cooling within an ice chest or similar such beverage cooling apparatus.

Yet another object of the present invention is to provide an ice chest container partition device which is simple and durable in construction, economical to manufacture, and is easily and efficiently employed for the purpose intended.

The foregoing, and other objects hereof, will be readily evident upon a study of the following specification and accompanying drawings comprising a part thereof.

DETAILED DESCRIPTION OF THE INVENTION

Figures 1, 2, 3, 4, 5, 6, 7, 8, 9, 10:
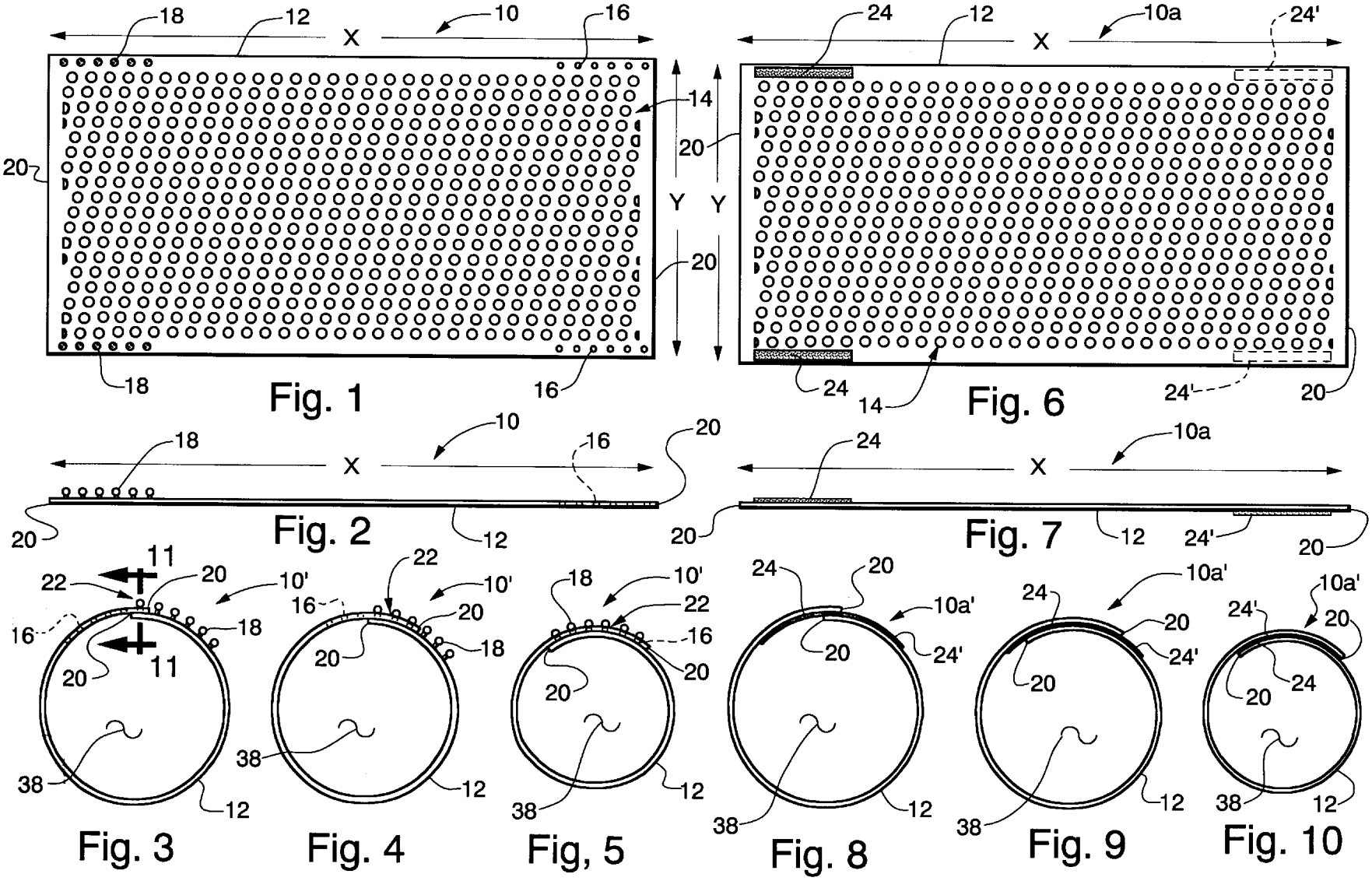
FIG. 1 is a side elevation view of the ice chest container partition device comprising the preferred embodiment of the instant invention, being therein shown in a flat unassembled configuration thereof.
FIG. 2 is a top view of the ice chest container partition device as shown in FIG. 1.
FIG. 3 is a top assembled view of the preferred embodiment ice chest container partition device of instant invention.
FIG. 4 is a view similar to that shown in FIG. 3, therein, however, illustrating diameter adjustment assembly of said preferred embodiment ice chest container partition device of instant invention.
FIG. 5 is another view similar to that shown in FIG. 3, therein, however, illustrating in turn yet another diameter adjustment assembly of said preferred embodiment ice chest container partition device of instant invention.
FIG. 6 is a side elevation view of an alternate embodiment version of the ice chest container partition device comprising the instant invention, being therein shown in a flat unassembled configuration thereof.
FIG. 7 is a top view of the alternate embodiment ice chest container partition device as shown in FIG. 6.
FIG. 8 is a top assembled view of the alternate embodiment ice chest container partition device of instant invention.
FIG. 9 is a view similar to that shown in FIG. 8, therein, however, illustrating diameter adjustment assembly of said alternate embodiment ice chest container partition device of instant invention.
FIG. 10 is another view similar to that shown in FIG. 8, therein, however, illustrating in turn yet another diameter adjustment assembly of said alternate embodiment ice chest container partition device of instant invention.

Referring to FIG. 1, the ice chest container partition device 10 of present invention, in the preferred embodiment version and the structural features thereof comprising the same, are shown in an unassembled side elevation view configuration which structural features consist of a pliable material barrier body 12 in the form of a rectangular sheet having a longitudinal dimension X and a lateral dimension Y, which is provided within the peripheral boundaries thereof with a patterned regularly repeating plurality of openings 14, said body 12 having at a first longitudinal end near the respective lateral extremities thereof a set of longitudinally extending regularly spaced plurality of female connector openings 16 and at the opposing second longitudinal end near the respective lateral extremities thereof being provided with a corresponding longitudinally extending regularly spaced plurality of male connector protrusions 18 respectively adapted to be insertably cooperative with said female connector openings 16 in a male/female connectively insertive manner. As will hereinafter be illustrated and more fully explained, the patterned regularly repeating plurality of openings 14 are provided for the purpose of passing ice water to facilitate and enhance cooling efficiency and effects during use of said ice chest container partition device 10. Also as will hereinafter be fully illustrated and more fully explained, the set of longitudinally extending regularly spaced plurality of female connector openings 16 and the corresponding longitudinally extending regularly spaced plurality of male connector protrusions 18 insertably cooperative connectively therewith are provided for the purpose of assembling said body 12 into a cylindrical shape of adjustably varying diameter to provide an ice chest container partition device 10. It should further be noted that the body 12 is fabricated by standard techniques for the production of items made from pliable impervious plastic materials, and that the male connector protrusions 18 are preferably formed from the same pliable impervious plastic material as the body 12 and are integral therewith.

Referring now to FIG. 2 wherein is shown a top view of the unassembled preferred embodiment of the ice chest container partition device 10, therein more specifically illustrating the pliable material barrier body 12 longitudinally extended relationship of the regularly spaced plurality of female connector openings 16 to the corresponding regularly spaced plurality of male connector protrusions 18 whereby is accomplished variably adjustable cylindrical assembly of said body 12 for use employment thereof as a retentive barrier to provide an unimpeded opening for beverage container insertion within the ice pack of an ice chest cooler. It should be noted that the number of female connector openings 16 and male connector protrusions 18 comprising the corresponding pluralities thereof as respectively illustrated in FIGS. 1 and 2 is to be considered as exemplary only, wherein the specific numbers thereof could be correspondingly greater or lesser than that as shown. It should also be noted that the ice chest container partition device 10 unassembled configuration as shown in FIGS. 1 and 2 is that profile not only for non-use storage, but also for packaging and shipping so as to reduce to a minimum the space requirements therefor in storage and shipping.

Directing attention now to the preferred embodiment assembled ice chest container partition devices 10' as illustrated in FIGS. 3 through 5, wherein is shown connectable assembly of the pliable material body 12 to transform the same from a flat rectangular profile into an assembled ice chest container partition device 10' of cylindrical profile and variably adjustable diameter depending upon beverage container diameter to be accommodated therewithin and to efficiently accommodate within an ice chest other items and additional beverage containers of different diametrical sizes. As can be seen first in FIG. 3, the largest cylindrical profile diameter connective setting for an assembled ice chest container partition device 10' is achieved by insertable engagement respectively of the terminally longitudinal laterally extreme male connector protrusions 18 cooperatively within the corresponding female connector openings 16. From the assembled ice chest container partition device 10' largest diameter setting as shown in FIG. 3, the cylindrical size thereof to accommodate beverage containers of smaller diameter may be incrementally reduced by increased overlap of the longitudinally terminal ends 20 of the pliable material barrier body 12 and re-insertable connection of the male connector protrusions 18 cooperatively within the corresponding female connector openings 16 to thereby assemble an intermediate size ice chest container partition device as shown in FIG. 4, or assemble the smallest diameter size thereof by means of further overlapping the longitudinally terminal ends 20 and fully interconnecting all male connector protrusions 18 cooperatively within the corresponding female connector openings 16 as is shown in FIG. 5. Descriptive details of the male/female cooperative interconnection assembly 22 will be discussed on consideration of FIG. 11 hereinafter.

Turning attention now to FIGS. 6 and 7, wherein is shown an alternate embodiment ice chest container partition device **10*a* in the flat unassembled profile, which is modified by providing affixed Velcro component hook and pad interconnecting assembly means 24 and 24' to the respective longitudinal ends 20 of the pliable material barrier body 12 at the opposing lateral extremes thereof, whereby said device 10*a* is thereby enabled to be interconnectably assembled into an adjustable diameter cylindrical profile as previously described and as shown in FIGS. 8 through 10. An added feature of the alternate embodiment ice chest container partition device 10*a*, however, is that on assembly thereof to form the cylindrical profile 10*a*', the diametric setting is infinitely rather than incrementally variable from the largest to intermediate to smallest diameter settings between the interconnectable limits of the Velcro component hook and pad interconnecting assembly means 24 and 24' as shown in FIGS. 8 through 10, thereby providing an added flexibility in sizing a partition device 10*a*'** to both a beverage container and an ice chest cooler.

Figure 11:
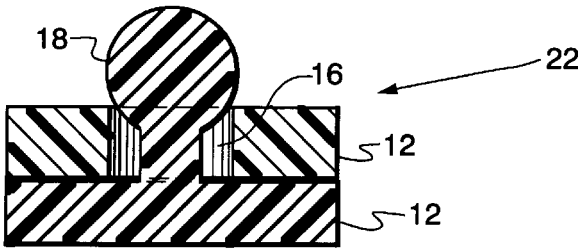
FIG. 11 is an enlarged side sectional view of the preferred embodiment ice chest container partition device assembly connecting means, as shown in FIG. 3 and seen along the line 11 —11 thereof.

Directing attention now to FIG. 11, showing detail of the male/female cooperative interconnection assembly 22, wherein it can be seen that the size of the male connector protrusion 18 is slightly larger than the diameter of the female connector opening 16 such that after the male member 18 is pliably inserted into and through the female opening 16 affixment is thereby effected as illustrated. Release of the affixment is achieved simply by withdrawal of the male member 18 from affixed engagement through the female opening 16.

Figure 12:
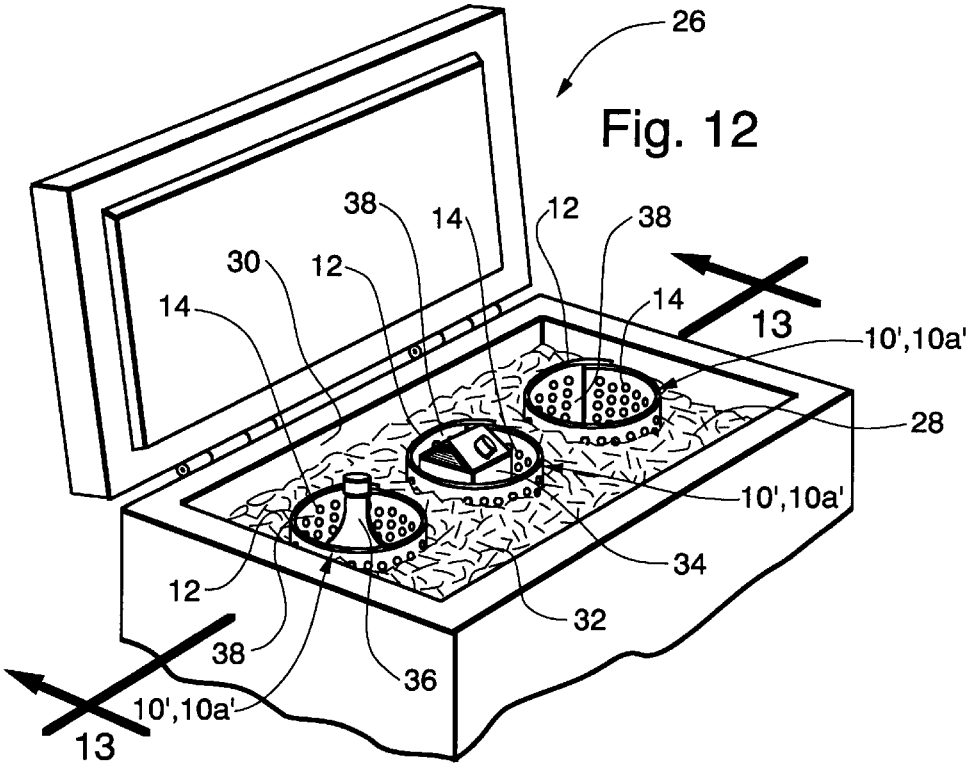
FIG. 12 is a fragmentary front perspective elevation view of an exemplary ice chest cooler, therein illustrating typical operational use employment of the ice chest container partition device of instant invention.
Figure 13:
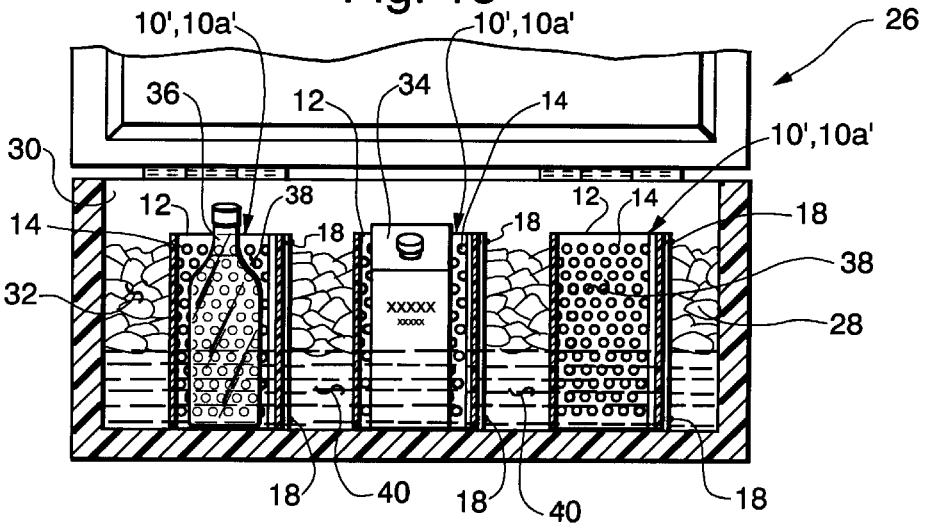
FIG. 13 is a front sectional view of the ice chest cooler, as shown in FIG. 12 and seen along the line 13—13 thereof.

Regarding now the use application illustrations of FIGS. 12 and 13, therein showing exemplary ice chest cooler 26 employment of the ice chest container partition device with chipped ice 28, in either the preferred or alternate embodiments 10' or **10*a*' thereof. In use application the partition devices 10'** or l0*a* are first positioned within the ice compartment 30 of an ice chest cooler 26 before the deposit of ice 28 therein to form a cooling ice pack 32, whereby the pliable material barrier bodies 12 respectively of the devices 10' or l0*a*' provide openings in the ice pack 32 to conveniently receive carton or bottle beverage containers 34 or 36 for cooling. Thus, beverage containers 34 or 36 may be easily removed or replaced within the ice retention barrier opening 38 provided within the ice pack 32 by means of the ice chest container partition devices 10' or 10*a*' without the ice 28 in the ice pack 32 falling into and filling said ice retention barrier opening 38. Also, additional beverage container 34 and 36 cooling is obtained as illustrated in FIG. 13 by means of the melted ice ice water 40 passing through the patterned regularly repeating plurality of openings 14 in the pliable material barrier body 12, to thereby surround and immerse lower portions of the beverage containers 34 and 36 therein.

Although the ice chest container partition device invention hereof, the structural characteristics and method of employment thereof in both the preferred and an alternate embodiment thereof, respectively have been shown and described in what is conceived to be the most practical and and efficient versions, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

We claim:

1. A diametrically adjustable ice chest container partition device in combination with an ice chest cooler said partition device comprising, a rectangular shaped pliable material barrier body having a longitudinal dimension and a lateral dimension, a patterned regularly repeating plurality of openings in said rectangular shaped pliable material barrier body, and a cooperatively engaqeable releasably connective adjustable interconnecting assembly having as components thereof a longitudinally inwardly extending regularly spaced plurality of female connector openings disposed at the corners of said rectangular shaped pliable material barrier body at one of the respective longitudinally separated laterally spaced ends thereof being adapted to releasably receive cooperatively in selective longitudinally adjustable connective insertion from an incremental to full engagement compressively therewithin a corresponding longitudinally extending regularly spaced plurality of pliable male connector protrusions disposed at the corners of said rectangular shaped pliable material barrier body at the other of the respective longitudinally separated laterally spaced ends thereof thereby being adapted to connectively assemble said rectangular shaped pliable material barrier body of said ice chest container partition device into an adjustably varying diameter cylindrical form to be employed within said ice chest cooler to provide an adjustably sized cylindrically shaped ice retention barrier opening therein to conveniently receive a specific beverage container from a selection of different diametrically sized beverage containers to accommodate the same or the like when an amount of ice is placed in the ice containing chamber of said cooler.

* * * * *